United States Patent [19]

Yu

[11] Patent Number: 4,578,967

[45] Date of Patent: Apr. 1, 1986

[54] COMBINED DOOR LATCH AND DEADBOLT ARRANGEMENT

[76] Inventor: Jer M. Yu, 8812 Lawrence Ave., Westminster, Calif. 92683

[21] Appl. No.: 370,771

[22] Filed: Apr. 22, 1982

[51] Int. Cl.[4] ..... E05B 59/00

[52] U.S. Cl. ..... 70/107; 70/462

[58] Field of Search ..... 70/107, 134, 462, DIG. 52; 292/244, 139, 143, 165, 167, 173

[56] References Cited

U.S. PATENT DOCUMENTS

| | | | |
|---|---|---|---|
| 197,531 | 11/1877 | Vetter | 70/462 |
| 580,890 | 11/1893 | Linsmayer | 70/107 |
| 3,129,579 | 4/1964 | Bellantuono | 70/107 |
| 3,672,714 | 6/1972 | Schultz | 70/107 |

FOREIGN PATENT DOCUMENTS

| | | | |
|---|---|---|---|
| 652562 | 12/1964 | Belgium | 70/462 |
| 931876 | 8/1955 | Fed. Rep. of Germany | 70/462 |
| 55618 | 11/1943 | Netherlands | 70/462 |

*Primary Examiner*—Robert L. Wolfe

*Attorney, Agent, or Firm*—Don B. Finkelstein

[57] ABSTRACT

A lock comprising a housing having a push latch bar and a deadbolt which are each extendible and fully withdrawable into the housing. The dead bolt is actuated to the two positions by an over-center spring and a lever having a relatively long arm and a relatively short arm. The short arm includes a cam follower. The lever is actuated by a cam which is turned by a key. A detent notch in one edge of the dead bolt cooperates with a locking lever pivotally mounted within the housing for actuation by the cam. The push latch bar comprises a head and tail of similar thickness but different width, joined by a body having a width similar to that of the head but a thickness less than that of the head or the tail, forming opposed shoulders on the head and the tail. A pusher bar is urged by a spring against the shoulder formed by the head. A second lever pushes against the shoulder formed by the tail to the push latch bar. The push latch may be reversed so that the door can swing in either direction.

23 Claims, 12 Drawing Figures

COMBINED DOOR LATCH AND DEADBOLT ARRANGEMENT

BACKGROUND OF THE INVENTION

The present invention relates to a door lock incorporating both a dead bolt and a push latch. Preferably, the device is enclosed in a housing which is relatively narrow so that it can be installed within the edge of a door, such as a security screen door or storm door which, in many instances, is produced from aluminum or other metal.

In the past, many such doors have been provided with rather flimsy locking structures which will hold the door closed for most purposes, but which can easily be defeated by anyone desiring to make an unauthorized entry. One such locking structure, for example, has comprised a detent structure which is fixed on the interior portion of a pivotable door handle. When the door closes, the detent structure pushes a complementary detent device out of the way. In many cases, this latter device comprises a spring-biased pin or bar which then snaps back into place as the detent portion of the handle continues to move past it as the door pivots to the final, closed position. When an occupant desires to open the door, he merely pivots the handle to a position in which the detent structure thereon rotates out of a position in which it can contact the pin. The locking structure for such doors has normally comprised a simple device which prevents the handle from being pivoted.

It is well known that locks of this type are relatively ineffective for prohibiting unauthorized entry. Similarly, it is well known that most police burglary departments recommend that doors be locked with a bolt having a minimum throw or extension out of the door of one inch. Obviously, locks such as this prohibit all but the most determined of unauthorized entries. Such locks have been shown (for example) in U.S. Pat. Nos. 2,380,708; 3,384,404; 3,626,507; 3,917,329; and 4,182,145.

Although there are locks available for such doors which are more secure than that prior art screen door lock described above, most of them have been manufactured in such a way that they must be relatively thick. This results in the lock having to be mounted on the exterior surface of the door with, in some cases, a key-actuated cylinder extending through a bore in the door (see, for example, U.S. Pat. Nos. 2,380,708; 3,626,507; and 3,917,329). Since many such doors are located very close to the main structural door of the entry within which they are mounted, it is sometimes quite difficult, if not impossible, to use such a lock since the two doors cannot be closed simultaneously. Also, the appearance is one of "add-on" hardware which leaves the impression of poor quality workmanship.

It is also desirable to have a lock which may be encased in a relatively thin housing which can be inserted into the edge of a rather thin door, such as an aluminum security screen door. Preferably, the lock would also include a push latch bar which will hold the door closed until a handle or doorknob is turned. Prior art push latches of this general type, although of rather complex structures, have been shown, for example, in U.S. Pat. Nos. 3,361,462 and 4,286,812. Still further, it is preferred that structure be provided to allow modification of the push latch operation so that the installer may carry a single lock in his inventory for use regardless of whether the door hinge is at the right or left hand side of the door.

SUMMARY OF THE INVENTION

The present invention relates to a lock having a very thin body so that the lock can be installed within the edge of a rather thin door, such as a security screen or storm door. Accordingly, the esthetic appearance of the door is unchanged, except for the presence of a key-actuated cylinder on the outside or both sides of the door, or in some cases, a thumb latch on the inner side of the door. In either case, of course, a door knob or door handle may be provided on each side of the door to facilitate opening the door.

In the presently preferred embodiment of this invention, a dead bolt may be fully extended or fully retracted into the housing by means of a cam which is actuated by a key-actuated lock extending through both the housing and the door in which the housing is mounted. The cam acts upon a first actuating lever which may be pivotally mounted in the housing so as to have a rather short end, including a cam follower, and a long end which effects the throw of the dead bolt. An over-center spring may be fixed between the housing and either the dead bolt or the throwing end of the actuating lever to aid in moving the dead bolt to its final position, once motion in either direction is initiated by the cam.

The dead bolt may be provided with a detent notch for receiving the detent end of a locking lever when the deadbolt is fully extended. In this manner, the deadbolt cannot be forced back into the housing by a person attempting to break through the lock. In order to unlock the door, a cam, rotatable by the key-actuated lock, may be rotated in a direction which will cause the actuating lever to retract the dead bolt. Shortly before the actuating lever is so acted upon by the cam, however, the locking lever may be pivoted to a position in which the detent end is withdrawn from the notch so that retraction of the dead bolt will not be inhibited.

The lock may also include a push latch which is reversible so that the lock can be employed in either a right hand or left hand swinging door. In one embodiment, the push latch bar may comprise a head and a tail of substantially the same thickness, as determined when viewing the edge of the door, with the head having a greater width or top to bottom dimension, when in its normal operating position. The head and tail may be joined by a body of approximately the same width as the head, but which is thinner than either the head or the tail. In this manner, a cutaway portion may be formed on each side of the body of the push latch bar so that the head and tail form shoulders on each side of the bar at each end of the central body.

In another embodiment, the push latch bar may simply be cut away between the head and the tail to provide a central cut away portion which extends to one of the body edges. In this instance, the opposite body edge may be left intact along the cut away portion to aid in guiding the bar in its movement. A similar cut away may be made on the opposite side of the latch bar. In this manner, both of the top and bottom edges of the latch bar will provide approximately one-half the thickness of the bar as a sliding surface. Also in this embodiment, a small tongue may be provided on each side of the latch bar at the head and the tail for sliding cooperation with mating slots in the adjacent side walls of the body. This structure will aid in controlling the movement of the push latch bar and prevent it from twisting and jamming in the body.

A spring-biased pusher may act against a shoulder of the head of either of the embodiments of the push latch bar to normally bias the bar to a position in which the head's striker or pusher face and back or lock face are at least partially extended out of the housing. A second actuating lever may be mounted on a handle-actuated hub within the body to both to retract the bar, when actuated, and to form a stop for abutment with a shoulder on the tail of either of the embodiments of the latch. A movable stop means may be provided in the housing for cooperation with the second actuating lever to position the latter so that it will act as a positive stop for movement of the latch bar out of the housing.

The movable stop means may comprise a machine screw or bolt, threaded into one wall of the body so that the head of the screw is seated flush with the opposite wall of the body. The screw may be located so that it acts as a stop for the second actuating lever to limit movement of the latch bar out of the housing.

When the door is to be opened under normal conditions, the second actuating lever may be rotated by cooperation of the hub with the shank of the handle to pull the latch bar into the housing against the force of the pusher. When the handle is released, the biasing force exerted by the pusher will again force the latch bar out of the housing to its operative position.

The movable stop means located in the housing may cooperate with the second actuating lever so as to limit the movement of the lever in one direction under normal conditions to positively stop the movement of the latch bar out of the housing. When the stop is moved, e.g., the machine screw is removed, the second actuating lever may be allowed to rotate further due to a spring biasing force, i.e., a distance sufficient to allow the tail to be drawn past the second actuating lever so that the entire latch bar can be pulled out of the housing. The latch bar can then be turned over to reverse the position of the striker and back faces, and then reinserted into the housing. The stop means can then be returned to its normal position, e.g., the machine screw reinstalled, so that the actuating lever again acts as an abutment surface which is suitably located to prohibit removal of the latch bar from the housing.

Such a movable stop means might, as another example, comprise a device which can be moved by rotation of a movement control bolt or machine screw extending to the surface of the housing which is mounted flush with the edge of the door. Also, if desired, a friction means may be installed in the housing from one of the sides thereof to positively prohibit movement of the stop means, even if the stop means movement control bolt should be loosened over a period of time as a result of the opening and closing of the door.

Upon reading the following detailed description, those skilled in the art will realize that the present invention produces a significant improvement over locks of this type which have been known previously. The details of the description are offered here for the purpose of revealing exemplary structure which describes the spirit of the invention as embodied in presently preferred relationships, but which is not intended to limit the invention.

DETAILED DESCRIPTION

Figure 1:
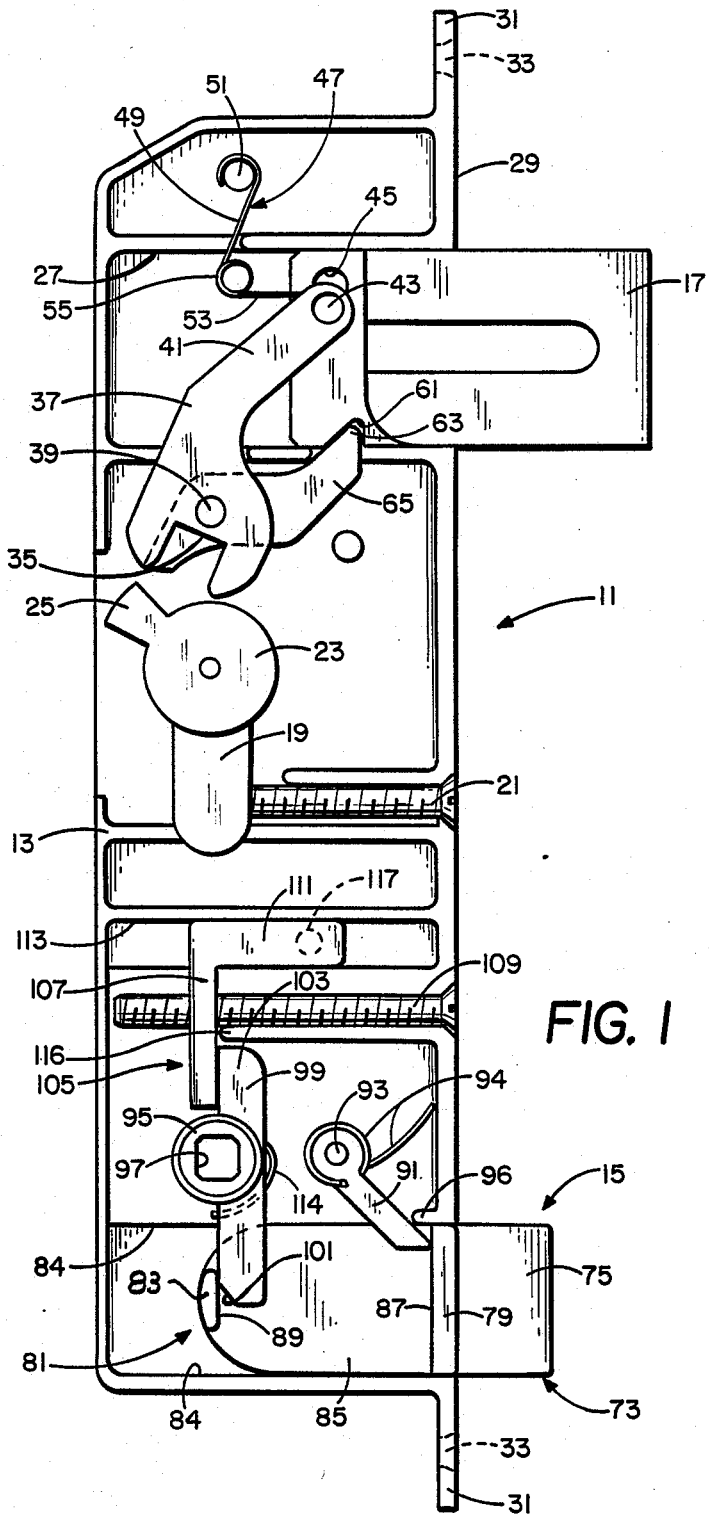
FIG. 1 comprises a side view of an embodiment of the invention, with a portion of the housing removed to more clearly illustrate various details.

Referring to FIG. 1, there is shown a lock 11 having a body or housing 13, within which is mounted a retractable push latch or latch bar 15 and a dead bolt 17. A lock 19 may extend through the body so as to provide a key cylinder or thumb latch (not shown) at the outer ends for operation of the lock. As depicted in FIG. 1, the lock comprises a keyhole-shaped structure which may be held within the body by any suitable means such as a machine screw 21. A cam 23 may be mounted on the axis of rotation of the lock near the longitudinally central portion thereof so that an extension 25 of the cam will be rotated about the axis when the key or thumb latch is turned by someone intending to set or retract the dead bolt 17.

In this preferred embodiment, the dead bolt 17 may slide in and out of the housing within a close fitting slot 27. When the dead bolt is in the set or thrown position, as depicted in FIG. 1, it is preferred that the length of the dead bolt beyond the outer face 29 of the housing 13 be at least one inch.

The housing 13 may be provided with flangelike ends 31 having counter-bored apertures 33 therein, through which bolts or screws may be passed in order to hold the housing within an edge of the door with which the lock is to be employed (not shown). Thus, when the dead bolt 17 is in the set or extended position as depicted in FIG. 1, and the door is closed, the dead bolt will extend a substantial distance into the adjacent door jamb preventing opening of the door.

In order to actuate the dead bolt from the position shown in FIG. 1 to that shown in FIG. 3, for example, one would insert a key (not shown) into the lock 19 and rotate the key in the clockwise direction (as viewed in the drawings), causing the cam extension 25 to rotate out of alignment with the lower portion of the lock 19 and into contact with a cam following slot 35, which is wider than extension 25 for a purpose to be described below, located in an adjacent end of a first actuating lever 37. In other words, the cam follower 35 normally extends into the path of rotation of the cam member 25 so that, when the cam is rotated by turning the lock, the extension 25 must make contact with one of the opposed sides or edges of the slot 35.

The actuating lever 37 is preferably mounted to pivot about a pin 39. In this embodiment, it is preferred that the pin 39 be fairly close to the end of the lever containing the cam follower 35. As a result, the second end of 41 of the lever 37 is relatively long and, at its distal end, may be connected to the dead bolt 17 by means of a pin 43 which may move within a slot 45 in the inner end of the dead bolt 17. In this manner, the dead bolt may move within the slot 27 along an axis or plane which is perpendicular to, and does not intersect, the axis of pin 39 and the axis of lock 19 and cam 23. Thus, as the cam member 25 contacts one of the edges of cam follower 35, the first actuating lever 37 will pull the dead bolt 17 into the housing, through the position shown in FIG. 2 to that shown in FIG. 3. Of course, if the key is now rotated in the opposite direction, the dead bolt will move from the retracted position shown in FIG. 3, through the intermediate position of FIG. 2, to the extended or set position shown in FIG. 1.

With many prior art dead bolt locks, the movement of the dead bolt is accomplished entirely by turning a key. As a result, a relatively tight or rigid linkage must be provided in order to be sure that the dead bolt is fully extended or withdrawn when the key is removed from the lock. That kind of structure also produces large stresses on the key and, if friction should build up because of dirt, etc., the key may eventually break off in the lock.

In this preferred embodiment, however, it is desired that the movement of the dead bolt by a key be aided and even accelerated toward either position to which the operator desires to move it. For this purpose, an over-center spring 47 may be provided having a first leg 49 which may be attached to the housing by means, for example, of being wrapped around a pin 51. The spring may also be provided with a second leg 53 which may be fixed to the pin 43 or, if preferred, to the inner end of the dead bolt itself.

In any event, the legs 49 and 43 may be joined and integral with an helical coil 55, somewhat resembling the lower end of a safety pin.

Figure 2:
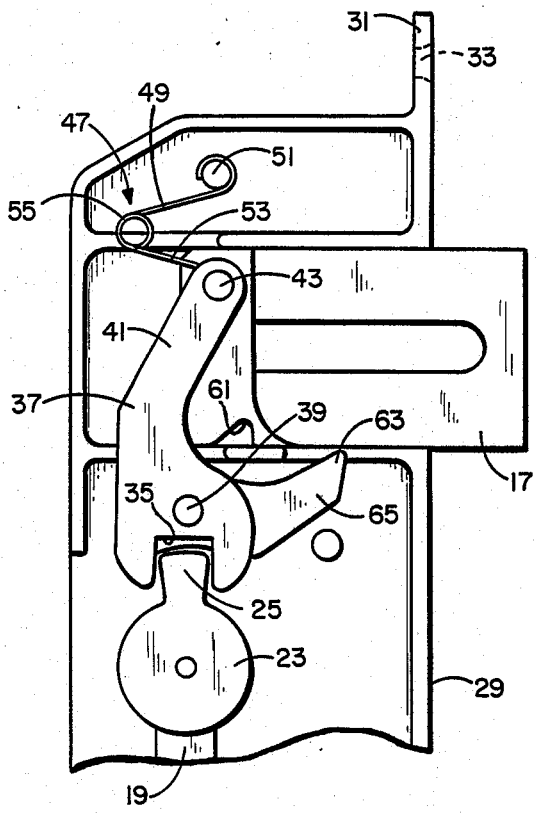
FIGS. 2 and 3 comprise views similar to the upper portion of FIG. 1, depicting the structure in various conditions of operation.
Figure 3:
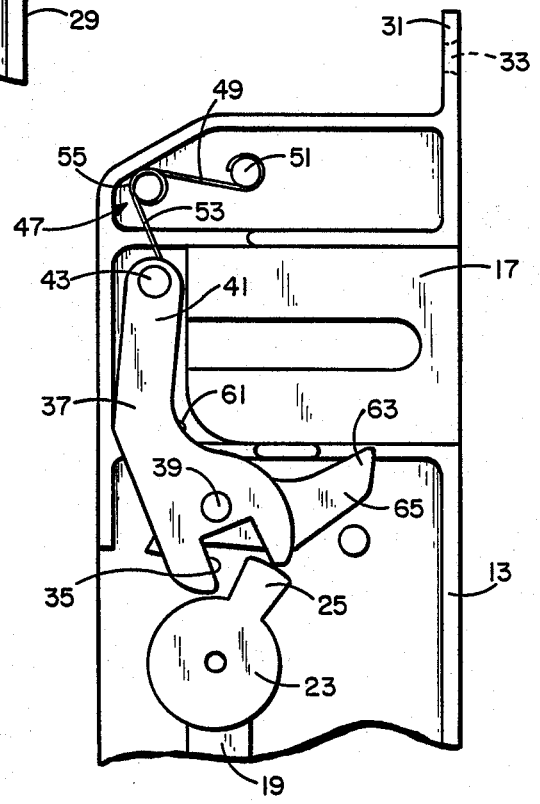

As the dead bolt is moved from the position of FIG. 1 to that shown in FIG. 3 by rotation of the cam 25 in cooperation with the first actuating lever 37, the spring 47 will move from the position shown in FIG. 1 to that shown in FIG. 2. As this occurs, the spring legs 49 and 53 will be forced toward a position in whch they are more nearly parallel, since the pins 43 and 51 will be moved closer together as the actuating lever 37 moves pin 43 along its arc of travel as lever 37 pivots about its axis in pin 39. This change in the position of the legs 49 and 53 of spring 47 will generate a force in coil 55 which will tend to urge the legs 49 and 53 to spread apart. As the pin 43 moves just slightly past pin 51, i.e., past its closest point of arcuate travel, relative to pin 51, the force exerted by coil 55 urging the legs 49 and 53 apart will urge the pin 43 to move away from pin 51, thus accelerating and aiding the movement of the dead bolt 17. Of course, this same over-center motion will occur when the dead bolt is to be moved from the retracted to the set position.

Stated in other terms, pin 51 may be fixed within the body 13 of the lock. On the other hand, pin 43 moves along an arc which is determined by the distance of pin 43 from pivot pin 39. When pin 43 and pin 51 achieve a relative positioning such that they are at their closest distance as the first actuating lever 37 is pivoted, a maximum force will be exerted on the coil 55 by the change of the relative positions of first leg 49 and second leg 53 of spring 47. The coil 55 will be exerting a reaction force which tends to spread the legs of the spring 47 as far apart as possible. When the pin 43 is moved in either direction relative to its closest point of travel with respect to pin 51, the reaction force generated in coil 55 will tend to push the dead bolt in the desired direction. Since, as clearly depicted in FIG. 2, an amount of "play" exists between the cam follower 35 and the cam extension 25, due to the fact that a cam follower slot is wider than extension 25, the cam extension 25 will not inhibit this tendancy of the dead bolt to be "thrown" by the spring 47. As the force of the spring takes over, all of the reaction force exerted on the key as it turns lock 19 is suddenly eliminated. Consequently, the dead bolt will be fully moved to its final position without requiring continued pressure on the key or close tolerances in the actuating linkage to achieve that final position.

When the dead bolt is fully extended, it is preferred that it be locked in that thrown or set position, so that someone seeking to make an unauthorized entry will not be able to insert a screwdriver or other tool between the door and the jamb and force the dead bolt back into the housing. In the case of the present invention, a detent slot 61 may be formed in one edge of the dead bolt 17 for cooperation with a complementary detent end 63 of a locking lever 65.

Figure 4:
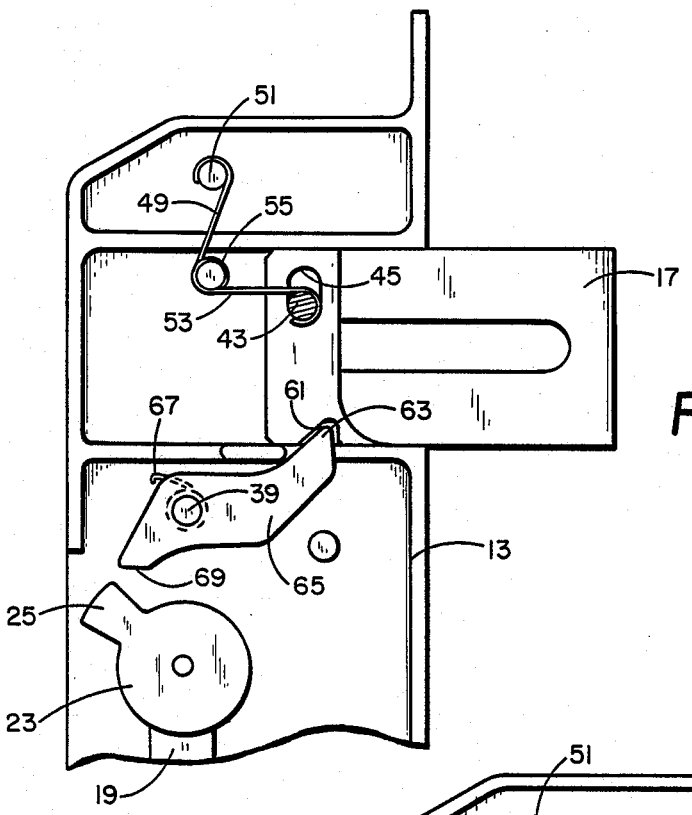
FIGS. 4 and 5 comprise views somewhat similar to FIGS. 3 and 4, but depicting the structure with certain elements removed for the sake of clarity.
Figure 5:
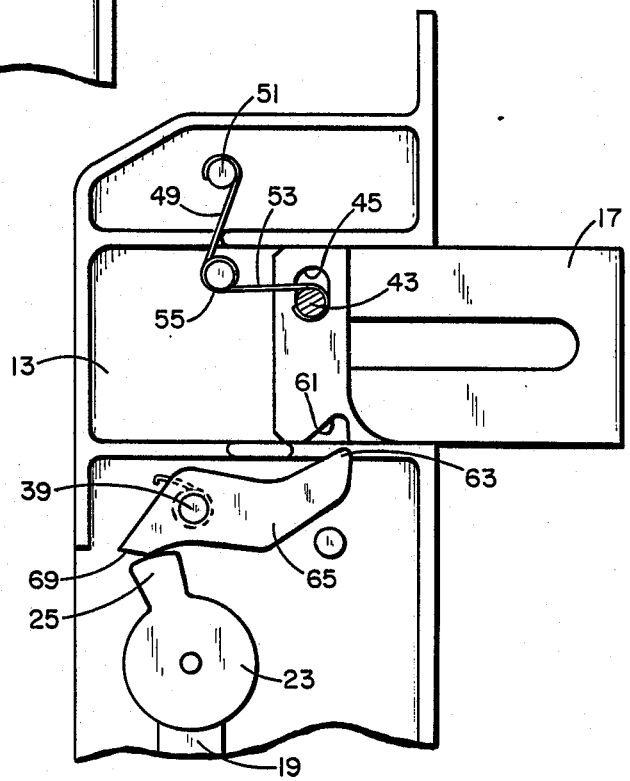

In FIGS. 4 and 5, actuating lever 37 has been eliminated in order to more clearly show the dead bolt locking lever 65. As shown in FIG. 4, the detent end 63 of the locking lever 65 extends into the complementary detent slot 61 in the edge of the dead bolt and this cooperative relationship may be accomplished as a result of a biasing force exerted by a coil spring 67. Spring 67 is fixed to one wall of the housing 13 and, preferably, includes a coil about pivot pin 39. The opposite end of spring 67 may be fixed to or abut one edge of the locking lever 65 so as to urge the lever into the position depicted in FIG. 4.

Locking lever 65 may be mounted for pivotal movement on pin 39. As the cam 25 rotates in the clockwise direction, as depicted in FIGS. 4 and 5, it will enter into contact with a cam follower surface 69 on lever 65. Movement of the cam 25 will cause the lever 65 to rotate in the clockwise direction as depicted in the Figure, causing the detent end 63 to be withdrawn from its extension into the detent notch 61, as depicted in FIG. 5. During this time, first actuating lever 37 will be actuated by cam 23 to pull the dead bolt 17 into the housing as depicted in FIG. 2. When cam extension 25 has passed beyond the cam follower surface 69, spring 67 will again cause the locking lever 65 to rotate in the counterclockwise direction. By this time, however, the notch 61 will no longer be in alignment with the detent end 63. Consequently, the detent end 63 can only push against the edge of the dead bolt as the dead bolt slides past it toward the FIG. 3 position.

When the dead bolt 17 is to be set, or thrown, actuating lever 37 will push it from the position shown in FIG. 3 to that shown in FIG. 1. When the notch 61 again is aligned with the end 63 of lever 65, the latter will move into the notch, again locking the dead bolt in place. Continued movement of the cam may pull the detent end 63 partially out of the notch 61, momentarily, but the locking relationship will immediately be regained when the cam is no longer in contact with the follower 69 on lever 65.

Figure 9:
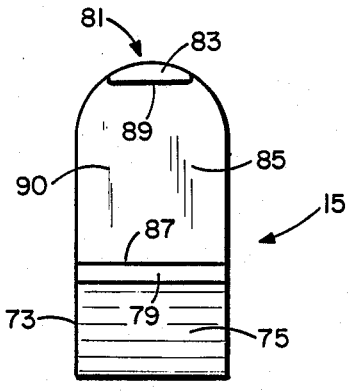
FIGS. 9 and 10 comprise, respectively, side and edge views of a push latch bar which may be employed with the present invention.
Figure 10:
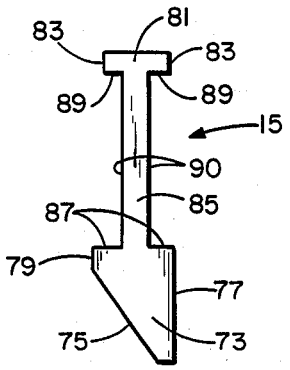

Referring again to FIG. 1, together with FIGS. 9 and 10, it can be seen that the push latch bar 15 of this first embodiment may include a head 73 having a pusher or striker face 75 and a back or holding face 77. As can be seen particularly well in FIG. 9, the striker face 75 terminates at a relatively small slide surface 79 which is substantially parallel to the back face 77.

At the opposite end of the push latch bar 15, a tail 81 may be formed, having opposed slide surfaces 83. It is preferred that the slide surfaces 83 on tail 81 be coplaner with surfaces 77 and 79 on head 73. In this manner, the coplaner slide surfaces will support the latch bar 15 for sliding reciprocation within a channel 84 in the housing 13. Thus, the coplaner surfaces 77, 79, 83, will slide against the adjacent faces of the channel 84 on the sides of housing 13 to support the push latch bar 15 in reciprocating movement into and out of the housing.

Intermediate the head 73 and tail 81, a body 85 may be formed which is thinner than either the head or the tail, but which may be as wide as the head (as depicted in FIG. 9). Also, as shown in FIG. 9, the tail 81 may be less wide than the head. Thus, the inner portion of the head 73 forms a pair of shoulders 87 which are opposed to a similar pair of shoulders 89 on tail 81. In other words, the latch bar 15 includes cutout or cut away portions 90 between the head 73 and tail 81 on each side of the body 85. As will now be shown, this configuration of the latch bar 15 will allow it to be installed in the body 13 with the pusher face 75 facing either direction, thus facilitating use of the lock in a door which may swing to the right or to the left.

Figure 6:
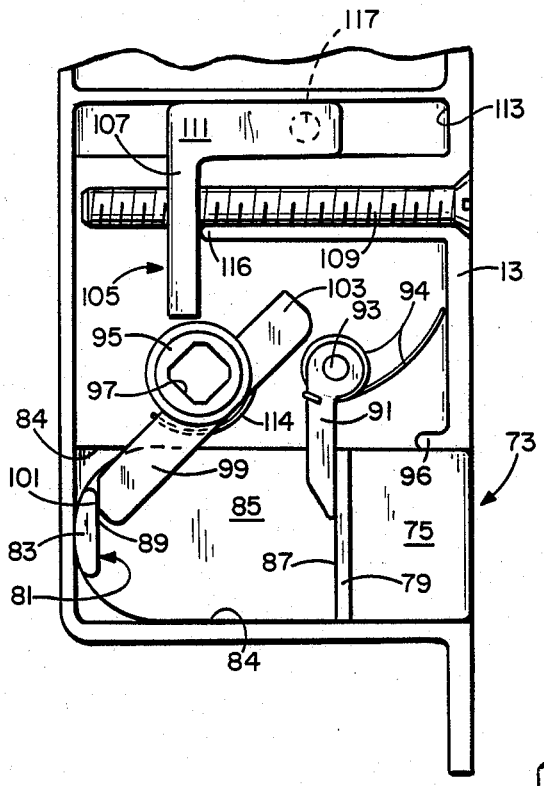
FIGS. 6 and 8 comprise views similar to the bottom portion of FIG. 1, depicting the structure and various conditions of operation.

Referring now to FIGS. 1 and 6, a pusher 91 may be pivotally mounted within the housing 13 for movement about a pivot pin 93. The pusher may be biased in the counterclockwise direction (as depicted in the drawing) by means of a coil spring 94. The pusher 91 acts against the shoulder 87 on head 73 to push the latch bar 15 out of the housing. The movement of the pusher may be limited by a stop 96 extending into the housing 13 from the face 29, thus preventing any inadvertent movement of the pusher.

A hub 95 may be rotatably positioned within the housing 13 and include a shaped passage 97 therethrough suitable for receiving the complementary shank (not shown) of a door knob or handle (also not shown). A latch, or second actuating, lever 99 may be fixed to hub 95 and be provided with an actuator surface 101 at a first end of the lever, which surface 101 normally abuts the shoulder 89 of tail 81 of the latch bar 15. When the hub 95 is rotated in the clockwise direction, as viewed in FIG. 6, pusher surface 101 will exert a force against shoulder 89, causing the latch bar 15 to be retracted into the housing 13 against the force of pusher 91. In this manner, the elements will travel from the position shown in FIG. 1 to that shown in FIG. 6. At this time, if dead bolt 17 is in the retracted position shown in FIG. 3, the door containing lock 11 can be pushed or pulled open depending upon its hinge mounting. When the handle or knob is released, no further force will be exerted on hub 95, thus allowing pusher 91 to force the push latch bar 15 out of the housing from the position shown in FIG. 6 to that shown in FIG. 1.

In order to prevent the latch bar from traveling completely out of the housing, second actuator lever 99 may be provided with a second, stop end 103 which may abut a movable stop 105.

While the stop 105 may be formed with any desired configuration, in this embodiment it is preferred that the stop include a first leg 107 having a threaded aperture therein through which a bolt or machine screw 109 may pass. The stop 105 may also include a second leg 111 which is substantially perpendicular to the first leg 107 and of a size which can conveniently slide back and forth within a channel 113 in housing 13. Consequently, when the push latch bar 15 is moved from the position shown in FIG. 6 to that of FIG. 1, the shoulder 89 at tail 81 will push the second actuator lever 99 until the end 103 of that actuator lever contacts the first leg 107 of stop 105. This relationship causes positive stopping of the movement of latch bar 15 so that the latter cannot come out of the housing.

Figure 8:
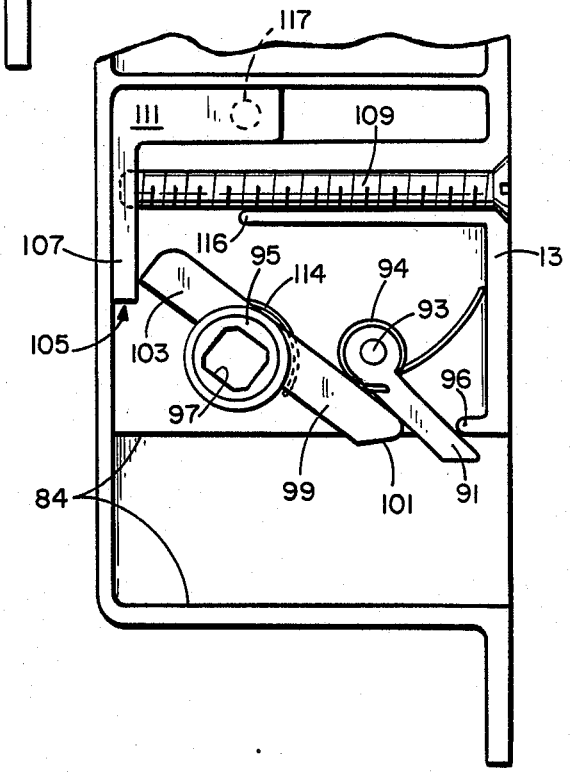

In order to reverse the push latch bar 15 to accomodate a door swinging in the opposite direction, the bolt 109 can be turned in the counterclockwise direction, forcing the stop 105 to move to the left, as seen in the drawings, guided by the cooperation of leg 111 in channel 113. As a result, the stop will travel from the position shown in FIG. 6 to that shown in FIG. 8. A coil spring 114 mounted on hub 95 may be used to cause the actuator lever 99 to rotate to the position shown in FIG. 8 and spring 94 will cause pusher 91 to rotate to a position in which it is against its stop 93. When this occurs, the tail 81 of the latch bar may be moved past second actuator lever 99 and pusher 91, allowing the push latch bar 15 to be pulled out of the housing. The push latch bar 15 may then be reversed, i.e., the back face 77 may be positioned toward the viewer, and the push latch bar 15 then reinserted into the housing. Then, bolt 109 can be turned in the clockwise direction, pulling the stop 105 forward in the housing until it reaches the position shown in FIG. 1, at which point, it contacts stop 116. At that position, stop 105 will again prevent the latch bar from being pulled out of the housing. The shoulders 87 and 89 formed in the newly positioned cutout 90 on the body 85 will then cooperate with the pusher 91 and actuator surface 101 on second actuator lever 99, respectively.

If desired, a bolt or machine screw 117 may be threaded into one side of housing 13 in order to more firmly fix stop 105 in place. In this manner, additional insurance may be provided that opening and closing of the door will not eventually work to loosen the bolt 109 and allow the latch bar 15 to inadvertantly fall out or jam the door.

Figure 7:
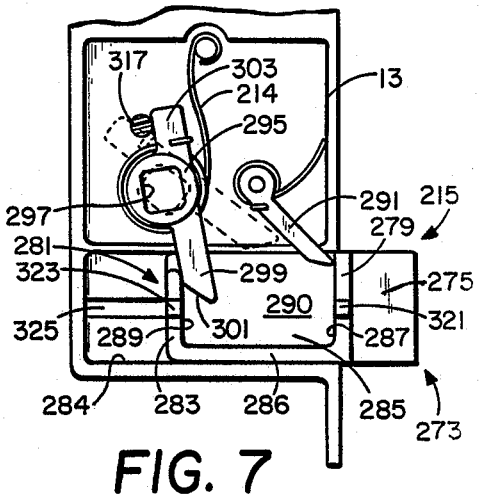
FIG. 7 comprises a view similar to FIG. 6, with the push latch bar in the extended position, showing an alternate embodiment of the push latch bar and a machine screw-type stop means.

As can be seen in FIG. 7, the lower portion of the lock body 13 may be provided with a push latch bar 215 having a head 273 which includes a pusher face 275 which ends in a slide surface 279. Slide surface 279 is substantially parallel to a back face (not shown) on the push latch bar and a coplaner surface 283 on tail 281. In this embodiment, head 273 and tail 281 may be joined by a body 285 having an edge portion 286, thus providing a wall about a cut away portion 290 on nearly three sides thereof. In this embodiment, tail 281 is slightly narrower, or of less width than head 273, as depicted in the Figure. Also, the opposite side of the bar 215 (away from the viewer) may be provided with a cut away substantially identical to that shown at 290, but the open side of that second cut away will extend to the opposite edge of the bar 215 (i.e., the bottom of the latch bar as seen in FIG. 7). In this manner, the bar 215 may either be positioned within channel 284 as shown, or it can be turned over or reversed so that the back face will be seen by the viewer. In either position a cut away portion 290 will be positioned so that a pusher 291 and a second actuating or latch lever 299 may extend into the cut away portion. Thus, pusher surface 301 on lever 299 may cooperate with shoulder 289 for retraction of the push latch bar 215, and pusher 291 may cooperate with shoulder 287 on head 273 to urge push latch bar 215 to its extended position.

In this embodiment, head 273 may be provided with a tongue 321 and tail 281 may be provided with a tongue 323. Similar tongues may be provided on the opposite side of latch bar 215 and complementary grooves 325 may be formed in the walls of body 13 within channel 284. Thus, latch bar 215 will be positively guided in its reciprocation in the channel 284.

Further, the body edge portion, one of which is shown at 286, which are each approximately one-half the thickness of the bar 215 (since their thickness dimensions terminate at the cut away opening on the opposite side of the body) will also serve to guide the reciprocation within channel 284.

In the embodiment depicted in FIG. 7, second actuating lever 299, which is fixed to hub 295 having an opening 297 for receiving the shank of a handle, and which is biased in the counterclockwise rotation direction by spring 214, may be stopped in its rotation or pivotal movement in a very simple manner. In this instance, a machine screw 317 (shown in section) may be threaded into one side wall of housing 13 so that the head thereof (not shown) will be flush with the opposite side wall. The screw 317 may be located in this first position so as to extend into the pivot arc path of the second end 303 of second actuating lever 299, thus limiting the pivotal movement of this lever to the position shown in FIG. 7. When screw 317 is removed, i.e., moved to its second position, spring 214 will pivot the second actuating lever 299 to the position shown in phantom, allowing the bar 215 to be pulled out of the body 13, turned over, and then reinserted into channel 284. Pushing the latch bar 215 all the way into the housing and turning hub 295, via the application of force to the opening 297, will allow reinstallation of screw 317 to its first position.

This structure, while very simple, will provide a positive stop for the pivotal movement of second actuating lever 299 and the location of machine screw 317 cannot possibly be inadvertently altered by opening and closing the door over many years time. When the lock 11 is pulled out of the door, turning of screw 317 will cause its threaded cooperation with the housing to actuate the screw from its first to its second position. When the lock 11 is reinstalled in the door, the door will prohibit screw 317 from being turned out of its threaded mounting. Of course, this stop means 317 may also be used with push latch bar 15, if desired.

Figure 11:
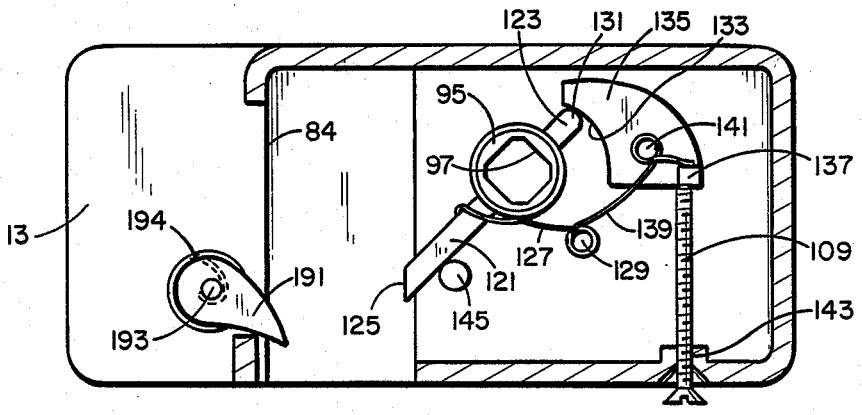
FIGS. 11 and 12 comprise side views of an alternate embodiment of certain structure which may be employed as the stop means for the latch bar, as seen in different conditions of operation.
Figure 12:
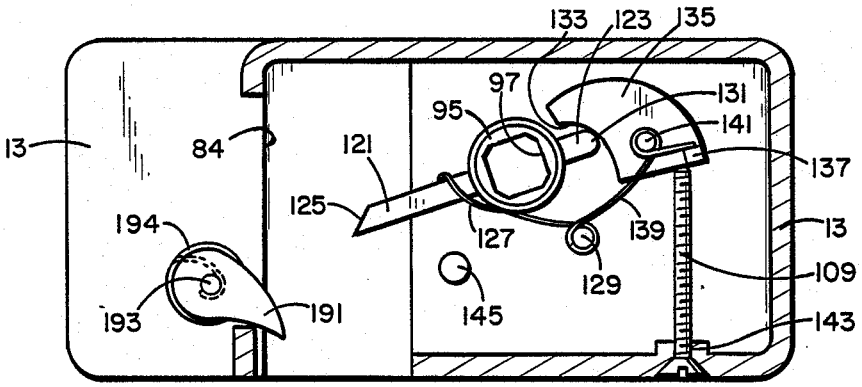

Referring now to FIGS. 11 and 12, another alternate embodiment of the latch bar stop and release means has been depicted. Those elements which may be substantially identical to those of the previously described embodiment have been provided with identical identification labels and no further description thereof need be made at this time. In this embodiment, a second actuator lever 121 and a stop lever 123 may be fastened to the hub 95. Of course, the elements 121 and 123 may be formed integral with one another and, if desired, with the hub 95. The second actuator lever 121 may include a pusher surface 125 which produces the same result as the pusher surface 101 described previously. A spring 127 may grip one edge of the pusher lever 121, as illustrated. The opposite end of the spring may be fastened upon a pin 129. The spring 127 will thus bias the second actuator lever 121 and hub 95 in the counterclockwise direction as illustrated.

The stop lever 123 may include a cam follower end 131 which closely follows a cam surface 133 on a release actuator 135. A tab 137 formed on the release actuator 135, may be acted upon by a spring 139 to pivot the actuator 135 about a pivot pin 141, against the lead end of the bolt 109. Under normal operating conditions, with the structure in the configuration shown in FIG. 12, the bolt 109 may be threaded into an aperture 143 in the housing 13 and held in that position by the threaded relationship. Under those conditions, the release actuator 135 is held in the position shown in FIG. 12 and the cam follower end 131 of the stop lever 123 abuts the cam surface 133 as illustrated. Consequently, the second actuating lever 121 cannot travel in the counterclockwise direction any further than that position depicted in FIG. 12. As a result, the latch bar cannot be pulled out of the housing.

On the other hand, when the bolt 109 is backed out of the aperture 143 a few turns, the release actuator 135 will pivot in the clockwise direction as tab 137 follows lead end of bolt 109 due to the force of spring 139, as depicted in FIG. 11. As this movement of release actuator 135 occurs, the cam follower end 131 will travel along the cam surface 133, allowing the second actuating lever 121 to travel in the counterclockwise direction until it abuts a fixed pin 145 in the housing.

When the latch bar has been reversed, the bolt 109 may be threaded back into the aperture 143. The head end of the bolt will push the release actuator 135 about its pivot on pin 141 against the force of spring 139. As this occurs, cam surface 133 will push the cam follower end 131 back to the position shown in FIG. 11, thus moving the second actuator lever 121 back toward its operative position, enabling the latch bar to be locked in the housing again.

In this embodiment, a pusher 191 has been depicted as being pivotable upon a pin 193 under the influence of a spring 194, thus depicting both an alternative shape for the pusher, as well as its positioning on the opposite side of the channel 83 from the second actuating lever 121.

Those skilled in the art will now understand that this combination of elements, relating to both a push latch bar, a dead bolt, and actuating structure for each, results in a lock which is very secure but simple, while at the same time, thin enough to fit within the edge of a very narrow door.

Having now reviewed this detailed description and the accompanying drawings, those skilled in the art will also realize that the present invention may be embodied in a wide variety of structures, many of which many not even physically resemble that depicted and described here. Nevertheless, such structures will clearly utilize the spirit and scope of this invention as now set forth in the following claims.

I claim:

1. A door lock comprising a housing for operative mounting upon a door; a dead bolt within the housing and movable between a first position in which it is completely within the housing and a second position in which it extends out of the housing a distance sufficient to lock a door upon which the lock is mounted, the deadbolt having detent means thereon for holding the deadbolt in the second position; a push latch bar within the housing and movable between a first position in which it is substantially completely within the housing and a second position in which it extends out of the housing a distance sufficient to hold a door upon which the lock is mounted in a closed position; the push latch bar and the deadbolt independently operable between each of the first and second positions thereof; a key-actuated lock mounted on the housing and extending therethrough and having first cam means mounted on the lock in operative relation thereto for rotation thereof upon actuation of the lock; first actuating lever means pivotally mounted in the housing and having a first end located adjacent the rotational path of the first cam means to effect pivotal movement of the first actuating lever when the first cam means is rotated, the first end including cam follower means for cooperation with the first cam means, a second end relatively distal from the first end and operatively connected to the deadbolt for actuation of the deadbolt, so that the deadbolt may be moved between the first and second positions therealong a line of movement substantially perpendicular to the axis of rotation of the first cam means, and means for pivotally mounting the first actuating lever means within the housing intermediate the first and second ends of the first actuating lever means; locking lever means mounted in the housing and having a first end located adjacent the rotational path of the first cam means, the first end including cam follower means for cooperation with the first cam means, a second end on the locking lever and distal from the first cam means, the second end including detent means located in cooperative relationship with the deadbolt so as to lock the deadbolt in the second position by cooperation with the deadbolt detent means, and means for pivotally mounting the locking lever means within the housing intermediate the ends of the locking lever means; mutually actuatable means mounted within the housing for pivotal movement therein; second actuating lever means operatively attached to the manually actuatable means and having a first end operatively positioned relative to the push latch bar for movement of the latter from the second position to the first position thereof, and a second end for limiting movement of the second actuating lever, during normal operation thereof, to a predetermined pivotal position during pivotal movement of the second actuating lever by the manually actuatable means; pusher means pivotally mounted within the housing in operative relationship with the push latch bar for urging the latter toward the second position thereof; means for exerting a biasing force on the pusher means such that the latter continuously urges the latch bar toward the second position thereof; stop means movably mounted in the housing for cooperation with the second end of the second actuating lever means and movable between a first position in which pivotal movement of the second actuating lever is limited to prohibit removal of the push latch bar from the housing and a second position in which the range of pivotal movement of the second actuating lever means is enlarged to allow complete removal of the latch bar from the housing; and means within the housing and extending to the exterior thereof for selectively actuating the stop means between the first and second positions thereof to provide a plurality of stop means positions betweeen the first and second position thereof whereby the amount of extension of the latch bar from the housing is controlled; and over-center spring means fixed between the housing and the deadbolt for biasing the deadbolt toward its first and its second position during movement thereof.

2. The door lock of claim 1 wherein the over-center spring comprises a first leg attached to the housing, a second leg attached to the second end of the first actuating lever, and a coil interconnecting the first and second legs, and further, wherein the attachment of the second leg to the second end of the first lever is arranged such that the most widely separated portions of the first and second leg of the over-center spring move toward and away from one another as the deadbolt travels between its first and second positions.

3. The apparatus of claim 1, or 2, wherein the cam follower means on the first end of the first actuating lever comprises a slot having a relatively loose fit with respect to the cam means.

4. The door lock of claim 1, or 2 wherein the push latch bar includes a head having a striker face and a back face, a tail of substantially the same thickness, but of lesser width than the head, and a body of substantially the same width, but of lesser thickness than the head, thus forming cutaway portions on each side of the body having opposed shoulders at the portions of the head and tail of the push latch means nearest the body for cooperative engagement with the second actuating lever means and the pusher means.

5. A door lock comprising a housing having a thickness small enough that the housing may be placed within an opening extending along a portion of an edge of a door; a deadbolt mounted in the housing for movement between a first position, in which it extends out of the housing a distance sufficient to extend into a jamb when the housing is mounted in a door, and a second position in which it is fully withdrawn into the housing; a lock extending through said housing; cam means operatively connected to the lock for rotation 11 the cam means about an axis extending through the lock when the lock is actuated by means external to the housing; pivot means fixed within the housing and having an axis substantially parallel to the axis about which the cam means is rotatable; first actuating lever means pivotally mounted upon the pivot means, the first actuating lever means having cam actuable means at one end thereof extending into the path of rotation of the cam means for cooperation therewith to pivot the actuating lever means about the pivot means in a direction determined by the direction of rotation of the cam means, the first actuating lever means also including actuating means at the second end thereof movably connected to the deadbolt for movement of the deadbolt between its first and second positions along a line of movement substantially perpendicular to the cam axis when the first actuating lever is pivoted about the pivot means upon rotation of the cam means; and biasing means interconnecting the housing and the deadbolt comprising a first leg fixed at one end thereof to the housing, a second leg fixed at one end thereof to the actuating lever means and an intermediate portion integral with and connecting the first and second legs, the biasing means comprising a flexible, over-center actuating means which urges the deadbolt toward the first and the second positions thereof, depending upon the direction and amount of rotation of the cam means.

6. The door lock of claim 5 including push latch bar means mounted for movement within and out of the housing and including a plurality of surfaces for supporting the latch bar in sliding relationship with the housing, the push latch bar further including head, tail, and intermediate body portions, the head being wider than the tail and thicker than the body portion, means within the housing for urging the push latch bar to an operative position in which it extends out of the housing, and means movable within predetermined limits for retracting the latch bar into the housing and preventing its removal from the housing.

7. The door lock of claim 5 including push latch bar means mounted for movement within and out of the housing and including a plurality of surfaces for supporting the latch bar in sliding relationship with the housing, the push latch bar further including head, tail, and intermediate body portions, the body portion including a body edge portion extending between the head and tail along one edge of the latch bar and providing a cut away portion on the body portion bounded by a wall on nearly three entire sides thereof, and means movable within the predetermined limits.

8. The door lock of claim 6 or 7 wherein the device further includes means for selectively altering at least one of the movement limits of the last-recited means for removal of the push latch bar from the housing.

9. The door lock of claim 8 wherein the retracting and preventing means comprises a second actuating lever means pivotally mounted in the housing, a first end of the lever means extending into cooperative relationship with the intermediate body portion and the tail portion for retracting the push latch bar into the housing when pivoted toward a first pivotal movement limit and for limiting the movement of the push latch bar out of the housing to prevent complete removal thereof when pivoted to a second pivotal movement limit and a second end, and wherein the movement limit altering means comprises stop means movably mounted in the housing for cooperation with the second actuating lever means second end.

10. The door lock of claim 9 wherein the stop means comprises means movably mounted within the housing and extending into a position for abutment with the second end of the second actuating lever, and means threadedly mounted in the housing for changing the position of the abutment means.

11. In a door lock having a housing mountable in an edge of a door, and a lock extending into the housing and accessible from at least one side of the door, when the lock is so mounted, and a deadbolt out of and withdrawable into the housing when the lock is actuated, cam means operatively connected to the lock for rotation when the lock is actuated, a lever pivotally mounted in the housing such that one end of the lever extends into the path of rotation of the cam means to effect pivotal movement of the lever when the cam means is rotated, the lever having a second end which is relatively distal from the pivotal mounting of the lever and which is movably attached to the deadbolt so that the deadbolt may be moved between its extended and withdrawn positions along a line of movement which is substantially perpendicular to the axis of rotation of the cam means, and means biasing the deadbolt toward both its extended and its withdrawn positions to supplement the force of the lever in moving the deadbolt.

12. The door lock of claim 11 wherein the biasing means comprises an over-center spring having a first leg, a second leg, and an intermediate coil between the legs, one of the legs being attached to the housing and the other operatively connected to the deadbolt in a relationship such that the free ends of the legs move toward and away from one another as the dead bolt is moved between its extended and withdrawn positions.

13. The apparatus of claim 11 or 12 including a second lever pivotally mounted in the housing and having a cam follower face which extends into the path of rotation of the cam means to effect pivotal movement of the second lever when the cam means is rotated, the lever having a second end including a detent means, and means on the deadbolt for receiving the detent means on the second lever, when the deadbolt is in the extended position.

14. The door lock of claim 11 including a door push latch bar which may be extended out of and withdrawn into the housing, the push latch bar including means for supporting the push latch bar in sliding relationship with the housing and for allowing removal of the push latch bar from the housing in order to reverse the latch bar.

15. In a door lock having a housing fastenable within an edge of a door and an operating handle shank which extends into the housing and is accessible from at least one side of the door, when the lock is so mounted, retractable push latch bar which normally extends out of the housing and retractable into the housing by actuation of the handle shank, the push latch bar comprising a head and a tail of a common thickness interconnected by a body of reduced thickness, to thus provide cut away portions having opposed shoulders at the head and tail on each side of the body, a hub within the housing for receiving a handle shank in such close-fitting relationship that rotation of a handle attached to the shank will cause rotation of the hub, a lever fixed to the hub and having a first end extending toward the latch bar so as to be positioned between the opposed shoulders on one side of the body, and means for urging the latch bar out of the housing comprising pusher means pivotally mounted in the housing and spring means for urging the pusher means into contact with a shoulder on the head of the push latch bar within one of the cut away portion thereof.

16. The door lock of claim 15 including means for limiting the rotation of the hub to prevent withdrawal of the push latch bar by limiting movement of the first end of the lever relative to the shoulder formed between the tail and body of the push latch bar.

17. The door lock of claim 16 including means for repositioning the movement limiting means within the housing, and means for pivoting the lever to a position in which it is no longer within a cut away portion on the body.

18. The door lock of claim 16 wherein the rotation limiting means comprises means received in the housing and extending into the pivot are path of a portion of the lever and selectively removable from the housing to permit pivotal movement of the first end of the lever to a position in which the first end does not extend between the opposed shoulders on one side of the body.

19. The door lock of claim 16, 17, or 18 including a deadbolt extendable out of and retractable into the housing, and means for actuating the deadbolt comprising a lever having a short end including a cam actuatable means and a long end including means operatively connected with the deadbolt, and means for mounting the actuating lever for pivotal movement within the housing.

20. In a door lock having a housing which may be fixed in the edge of a door, a hub in the housing which hub may support a shank holding at least one handle for opening the door, a retractable push latch bar comprising a head, having a striker face and a back face, a tail of substantially the same thickness but of lesser width than the head, and a body of substantially the same width as the head, thus forming cut away portions on each side of the body having opposed shoulders at the portions of the head and tail of the latch bar nearest the body; pusher means in the housing for imposing a force on one of the shoulders formed by the head of the push latch bar within the cut away portion on one side of the body for urging the push latch bar out of the housing; lever means pivotally mounted within the housing and having a first end extending into a cut away portion on one side of the body a distance sufficient to contact the shoulder formed by the tail of the push latch bar to prevent removal of the push latch bar from the housing, and a second end spaced from the first end and on the opposite side of the pivotal mounting for engaging a stop means; means for connecting the lever means to the hub for pivotal movement of the lever therewith to impose a force on the shoulder of the tail and thereby retract the push latch bar into the housing upon overcoming the force exerted by the pusher means as the hub is rotated; stop means movably mounted in the housing between a plurality of first positions wherein the second end of the lever means engaging the stop means and the push latch bar extend predetermined distances from the housing and a second position wherein the second end of the lever is free of contact with the push latch bar to allow removal of the push latch bar from the housing; means within the housing and extending to the exterior thereof and engaging the stop means for moving the stop means between the first position and second position thereof; and spring means for biasing the second end of the lever into contact with the stop means.

21. The door lock of claim 20 including deadbolt means extendable out of and retractable into the housing and means operable independently of the push latch bar for actuating the deadbolt to its desired position of extension or retraction including relatively long-throw lever means for actuating the deadbolt along a straight line path of travel which is perpendicular to the pivot axis of the lever means.

22. A door lock comprising a housing into which a deadbolt may be retracted in a first position thereof, and out of which the deadbolt may extend in a second position thereof for cooperation with a jamb adjacent to an edge of the door within which the door lock is mounted, a lock extending through the housing of the door lock, cam means actuated by the lock within the housing, actuating lever means mounted for pivotal movement within the housing including a cam surface on one end thereof and a pin on the opposite end thereof, slot means near one end of the deadbolt for movable cooperation between the actuating lever pin and the deadbolt, the ratio of the lever end lengths of the actuating lever relative to the pivot of the lever being such that the pin and slot actuating means result in a large throw of the deadbolt; and over-center spring means fixed between the housing and the deadbolt for biasing the deadbolt toward its first and its second position during movement thereof.

23. The door lock of claim 22 including a latch bar retractable into and extendible from the housing, means for urging the latch bar out of the housing for cooperation with a door jamb to hold a door including the door lock in a closed position, means for withdrawing the latch bar into the housing, and cam actuated means acting against the force of a biasing means for controlling the position of the means for retracting the door latch into the housing to prohibit removal of the latch from the housing.

* * * * *